US008092241B2

(12) United States Patent
Chang

(10) Patent No.: US 8,092,241 B2
(45) Date of Patent: Jan. 10, 2012

(54) ELECTRONIC TYPE REMOVAL PREVENTING CONNECTOR

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/779,096

(22) Filed: May 13, 2010

(65) Prior Publication Data

US 2010/0317215 A1 Dec. 16, 2010

(30) Foreign Application Priority Data

Jun. 16, 2009 (TW) ..... 98210744 U

(51) Int. Cl.
*H01R 13/62* (2006.01)

(52) U.S. Cl. ..... 439/305; 439/347; 439/38

(58) Field of Classification Search ..... 439/305, 439/347, 38, 660, 607.37
See application file for complete search history.

(56) References Cited

U.S. PATENT DOCUMENTS 5,803,762 A * 9/1998 Green ..... 439/347
5,865,640 A * 2/1999 Tadokoro ..... 439/347
6,768,643 B1 * 7/2004 Rust et al. ..... 361/732
7,578,691 B2 * 8/2009 Weksler et al. ..... 439/347
2010/0055980 A1 * 3/2010 Chen et al. ..... 439/607.01
2011/0076895 A1 * 3/2011 Zheng et al. ..... 439/660

FOREIGN PATENT DOCUMENTS

TW 1273161 B 2/2007

* cited by examiner

*Primary Examiner* — Hien Vu
(74) *Attorney, Agent, or Firm* — Chun-Ming Shih; HDLS IPR Services

(57) ABSTRACT

An electronic type removal preventing connector includes a joint and an electronic switch. The joint includes a port, and at least one through hole formed on an external surface of the joint and interconnected to the port. At least one set of electronic switches is installed onto the through hole, and includes a tongue passed through the through hole and having an oblique surface. If a metal plug of a portable electronic device is inserted into the port of the connector, the tongue of the electronic switch will be entered into a bolt hole of the metal plug to prevent the portable electronic device from being stolen. If the electronic switch is electrically conducted for an operation, the tongue will be separated from the through hole and the bolt hole, such that a user can remove the metal plug of the portable electronic device from the joint of the connector.

6 Claims, 5 Drawing Sheets

ELECTRONIC TYPE REMOVAL PREVENTING CONNECTOR

BACKGROUND OF THE INVENTION

1. Field of the Invention

The present invention generally relates to connectors, in particular to a connector with a removal preventing structure.

2. Description of Prior Art

Universal Serial Bus (USB) is a serial bus standard used for connecting external devices and applied extensively in computers, and it has a major feature of supporting hot plug and plug-and-play functions. If a device is inserted into a USB connector, the computer system will load a driver program that is required specifically by the device, and thus the USB is much more convenient than PCI and ISA buses.

In some USB connectors, a code lock structure is installed. For example, a USB connector lock structure as disclosed in Taiwan. Pat. No. 1273161 can prevent a portable electronic device from being stolen by a thief. Although some USB connectors of desktop devices come with a code lock structure, yet not all of them have the code lock, so that if a portable electronic device is inserted into a USB connector without a code lock, there will be a risk of the portable electronic device being stolen by thieves anytime.

SUMMARY OF THE INVENTION

Therefore, it is a primary objective of the present invention to overcome the shortcomings of the prior art by providing an electronic type removal preventing connector capable of locking a portable electronic device inserted into the connector to prevent the portable electronic device from being stolen by thieves.

To achieve the foregoing objective, the present invention discloses an electronic type removal preventing connector, comprising:

a joint, having a port formed thereon, and the port having a base therein, and the base having a tongue plate, and the tongue plate having a plurality of conducting terminals, and an end of the conducting terminal having a contact pin and a soldered pin, and the contact pin being fixed at the tongue plate, and the soldered pin being passed through the base and extended to the outside of the base, and at least one through hole being formed on an external surface of the joint and interconnected to the through hole; and an electronic switch, installed with at least one set onto the through hole, and having a tongue extended and passed through the through hole, and the tongue having an oblique surface provided for facilitating the joint of a transmission line to prop open the tongue.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
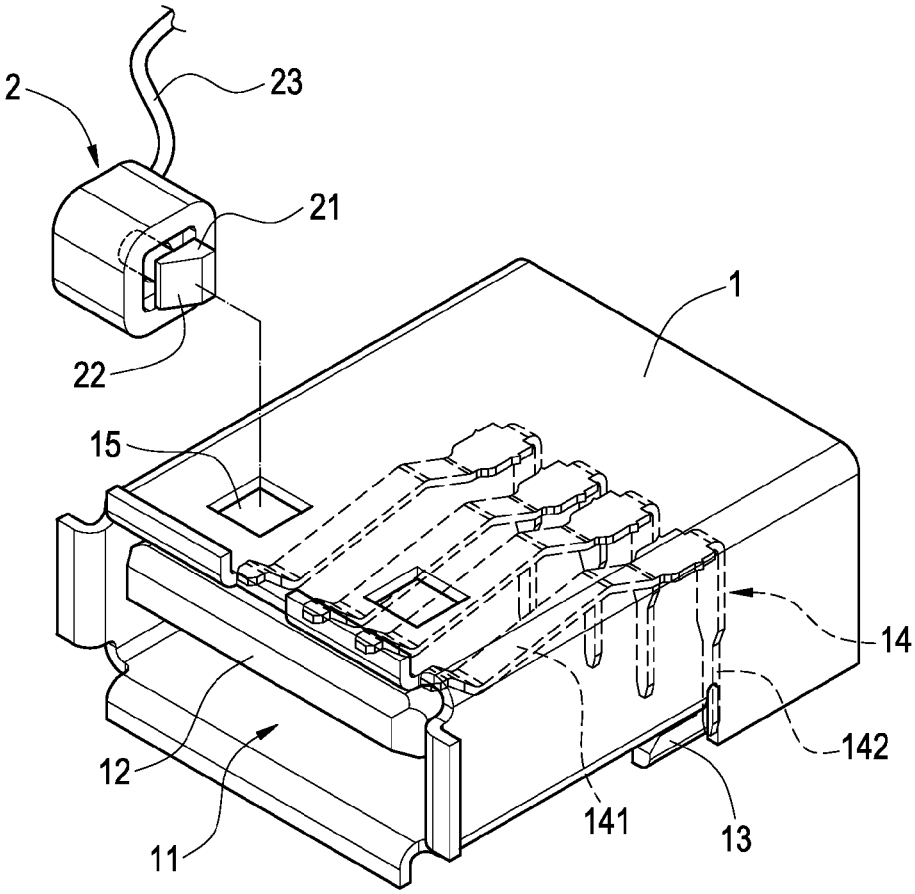
FIG. 1 is an exploded view of an electronic type removal preventing connector in accordance with the present invention.
Figure 2:
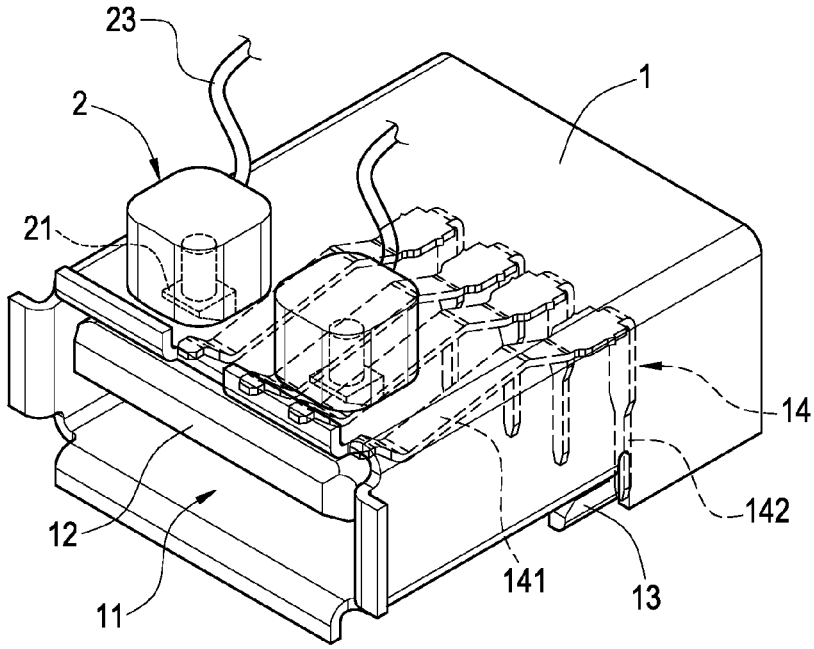
FIG. 2 is a perspective view of an electronic type removal preventing connector in accordance with the present invention.

With reference to FIGS. 1 and 2 for an exploded view and a perspective view of an electronic type removal preventing connector in accordance with the present invention respectively, the electronic type removal preventing connector comprises a joint 1 and an electronic switch 2.

The joint 1 is made of a metal or plastic material, and has a port 11 formed thereon, and the port 11 is a port for plugging a USB connector, and the port 11 contains a base 13 made of a plastic material, and the base 13 includes a tongue plate 12 coupled to the base 13, and the tongue plate 12 includes a plurality of conducting terminals 14 thereon, and an end of the conducting terminal 14 includes a contact pin 141 and a soldered pin 142, and the contact pin 141 is fixed onto the tongue plate 12, and the soldered pin 142 is passed through the base 13 and extended to the outside of the base 13, and at least one through hole 15 is formed on an external surface of the joint 1 and interconnected to the port 11.

The electronic switch 2 is a traditional solenoid valve and includes a magnetic line module and a spring installed therein, and at least one set of the electronic switches 2 is installed onto the through hole 15 and includes a tongue 21 extended and passed through the through hole 15, and the tongue 21 has an oblique surface 22 provided for facilitating a metal joint (not shown in the figure) of a transmission line to prop open the tongue 21. A magnetic line module (not shown in the figure) and a spring (not shown in the figure) are sheathed onto a rod of the tongue 21 and provided for controlling the movement of the tongue 21.

Figure 3:
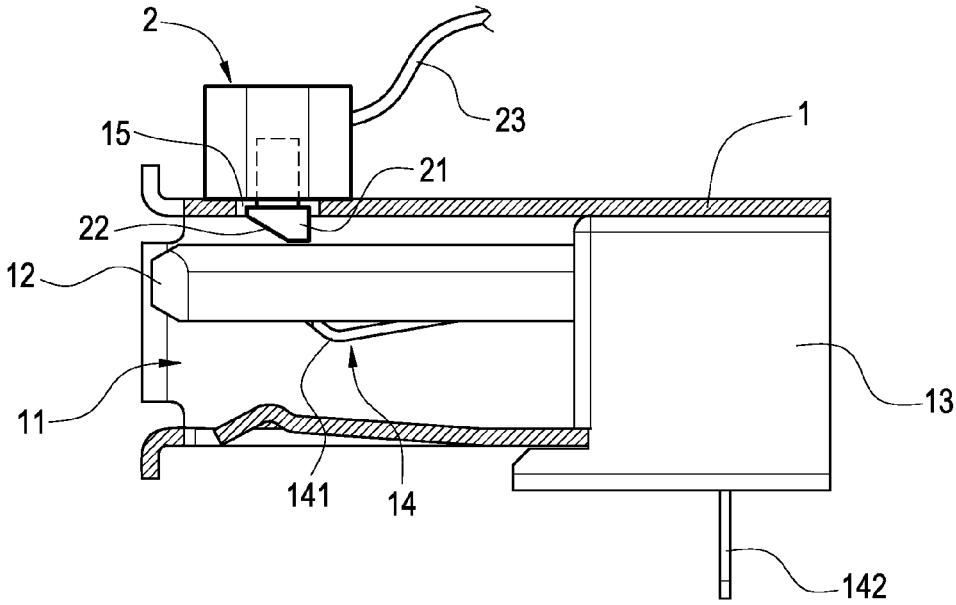
FIG. 3 is a cross-sectional side view of FIG. 2.

With reference to FIG. 3 for a cross-sectional side view of FIG. 2, if the electronic switch 2 is installed and coupled onto the joint 1 of the connector, the tongue 21 of the electronic switch 2 is passed through the through hole 15 of the joint 1 and disposed at the top of the tongue plate 12 of the port 11 for facilitating its locking to a joint of the transmission line inside the port 11.

Figure 4:
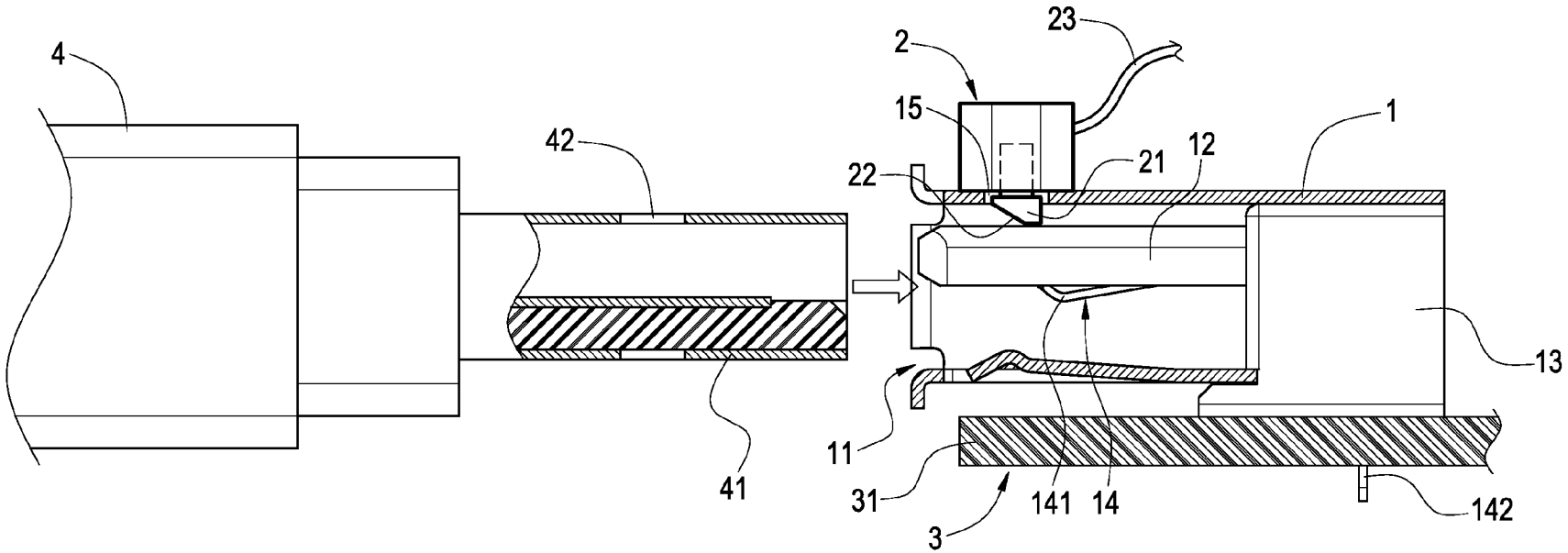
FIG. 4 is a schematic view of a using status of the present invention.
Figure 5:
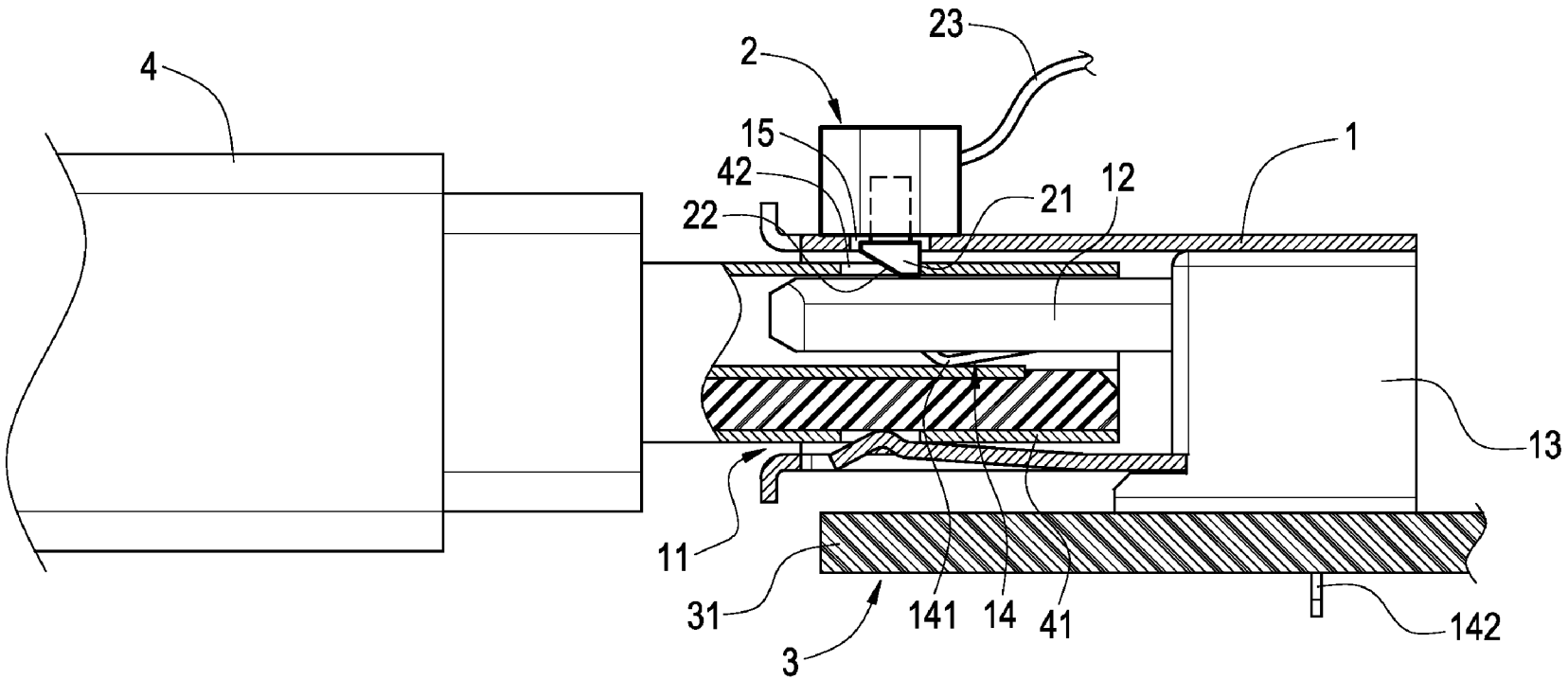
FIG. 5 is a schematic view of an operation of the present invention.
Figure 6:
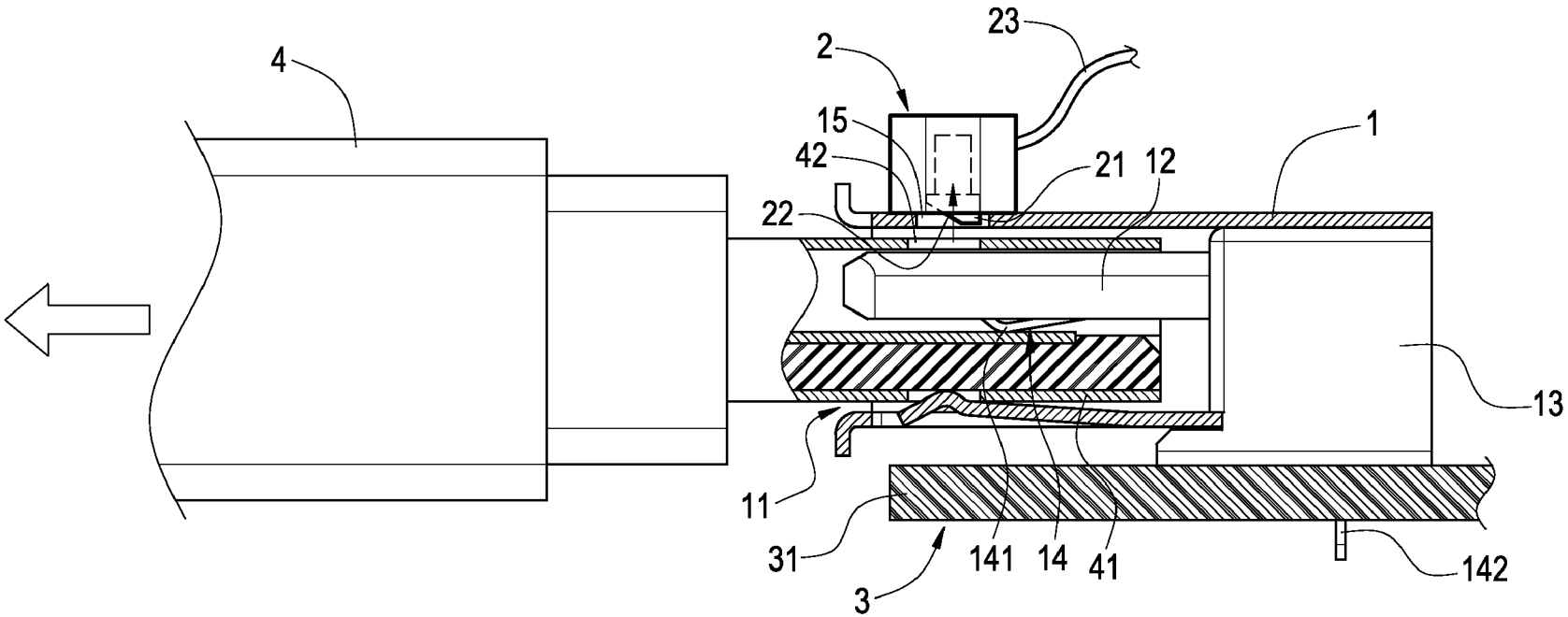
FIG. 6 is a schematic view of an operation as depicted in FIG. 5.

With reference to FIGS. 4 to 6 for a using status, and movements of the present invention respectively, after the connector of the present invention is electrically connected to a mainboard 31 of an electronic device 3 (such as a computer), a conducting wire 23 of the electronic switch 2 is electrically connected to the mainboard 31. If a user inserts a portable electronic device 4 (such as a flash disk) with a USB metal plug 41 into the port 11 of the metal joint 1, and the USB metal plug 41 is moved along the oblique surface 22 to open the tongue 21 by propping, and the USB metal plug 41 is further pushed into a position where the tongue 21 is no longer propped, and a spring (not shown in the figure) installed in the electronic switch 2 pushes the tongue 21 back to its original position, such that the tongue 21 is entered into the bolt hole 42 formed on an external surface of the USB metal plug 41 to prevent the portable electronic device from being stolen by thieves.

When the portable electronic device 4 is not in use, a user can operate the electronic device 3, such that the mainboard 31 of the electronic device 3 outputs electric power to the electronic switch 2, and a magnetic module (not shown in the figure) installed in the electronic switch 2 produces an attraction force to drive the tongue 21 to be separated from the through hole 15 and the bolt hole 42. Now, the user can remove the USB metal plug 41 of the portable electronic device 4 from the joint 1 of the connector.

After the USB metal plug 41 of the portable electronic device 4 is unplugged and removed, the mainboard 31 will no longer supply electric power to electronic switch 2, and the spring installed inside the electronic switch 2 will push the tongue 21 back to its original position.

While the invention has been described by means of specific embodiments, numerous modifications and variations could be made thereto by those skilled in the art without departing from the scope and spirit of the invention set forth in the claims.

What is claimed is:

1. An electronic device removal preventing connector, electrically coupled to a mainboard of an electronic device, and capable of locking a metal plug of a portable electronic device inserted into a connector joint, comprising:

a joint comprising a metal housing having a port for receiving therein a plug of the portable electronic device, and at least one through hole formed an external surface of the joint and interconnected to a connecting hole; and at least one set of electronic switches, installed on the through hole, and having a tongue disposed thereon and extended and passed through the through hole, and the tongue having an oblique surface and capable of being propped while the plug is being inserted into the port and the tongue returning to its original position when the tongue reaches the through hole, wherein the electronic switch is a solenoid valve and comprises a rod with the tongue of the solenoid valve extended perpendicularly from one end of the rod, a magnetic line module and a spring all being positioned surround the rod.

2. The connector of claim 1, wherein the port is a port of a universal serial bus (USB) connector.

3. The connector of claim 2, wherein the port includes a base therein, and the base includes a tongue plate coupled to the base, and the tongue plate includes a plurality of conducting terminals thereon, and each of the conducting terminals include a contact pin and a soldered pin disposed at an end of the conducting terminal, and the contact pin is fixed onto the tongue plate, and the soldered pin is passed through the base and extended to the outside of the base.

4. The connector of claim 1, wherein the plug is a universal serial bus (USB) plug.

5. The connector of claim 1, wherein the electronic device is a computer.

6. The connector of claim 1, wherein the portable electronic device is a flash disk.

* * * * *